US011195485B1

(12) United States Patent
Wu

(10) Patent No.: US 11,195,485 B1
(45) Date of Patent: Dec. 7, 2021

(54) METHOD OF DRIVING LIQUID CRYSTAL DISPLAY AND DISPLAY DEVICE UTILIZING SAME

(71) Applicant: HIMAX TECHNOLOGIES LIMITED, Tainan (TW)

(72) Inventor: Tung-Ying Wu, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 0 days.

(21) Appl. No.: 17/083,250

(22) Filed: Oct. 28, 2020

(51) Int. Cl.
*G09G 3/36* (2006.01)

(52) U.S. Cl.
CPC ... *G09G 3/3607* (2013.01); *G09G 2300/0439* (2013.01); *G09G 2320/0252* (2013.01); *G09G 2340/16* (2013.01)

(58) Field of Classification Search
CPC ..... G09G 3/36; G09G 3/3607; G09G 2300/0439; G09G 2320/0252; G09G 2340/16
See application file for complete search history.

(56) References Cited

U.S. PATENT DOCUMENTS

2004/0012551 A1* 1/2004 Ishii ..... G09G 3/3648 345/87
2013/0307835 A1* 11/2013 Wu ..... G09G 3/3611 345/212
2014/0232756 A1* 8/2014 Choi ..... G09G 3/36 345/690
2017/0084235 A1* 3/2017 Yeo ..... G09G 3/3648
2019/0371258 A1* 12/2019 Morein ..... G09G 3/3688

* cited by examiner

*Primary Examiner* — Antonio Xavier
(74) *Attorney, Agent, or Firm* — Winston Hsu

(57) ABSTRACT

A liquid crystal display includes a plurality of sub-pixels arranged in an array. A method of driving the liquid crystal display includes determining a frame rate weight according to a current frame rate of a plurality of image frames, performing linear prediction according to the current frame rate to generate an initial overdrive value of a sub-pixel, selecting an error correction value according to a previous gray level of the sub-pixel, generating an overdrive weight according to the previous gray level and a current gray level of the sub-pixel, generating an overdrive offset according to a product of the error correction value, the frame rate weight and the overdrive weight, combining the initial overdrive value and the overdrive offset to generate a corrected overdrive value, and driving the sub-pixel according to the corrected overdrive value.

14 Claims, 6 Drawing Sheets

METHOD OF DRIVING LIQUID CRYSTAL DISPLAY AND DISPLAY DEVICE UTILIZING SAME

BACKGROUND OF THE INVENTION

1. Field of the Invention

The invention relates to a display device, and in particular, to a method of driving a liquid crystal display and a display device utilizing the same.

2. Description of the Prior Art

In liquid crystal displays, the "gray level" or brightness of each pixel can be controlled by a driving voltage applied to the pixel. In the related art, the liquid crystal displays are known for having a relatively slow response with respect to the driving voltage, leading to undesirable artifacts such as ghosting, streaking and motion blur. A technique known as "overdrive" can be used to accelerate the response time of the liquid crystal displays, where an overdrive voltage that differs from a driving voltage required for the desired gray level is applied to the pixel, so as to speed up the transition of the pixel towards the desired gray level.

Nevertheless, how to determine the overdrive voltage remains challenging for the design of liquid crystal displays.

SUMMARY OF THE INVENTION

According to one embodiment, a liquid crystal display includes a plurality of sub-pixels arranged in an array, and a method of driving the liquid crystal display includes determining a frame rate weight according to a current frame rate of a plurality of image frames, acquiring a previous gray level of a sub-pixel of the plurality of sub-pixels from a previous frame of the plurality of image frames, acquiring a current gray level of the sub-pixel from a current frame of the plurality of image frames, the previous frame and the current frame being displayed by the liquid crystal display sequentially in time, selecting a first overdrive value from a first overdrive lookup table for use to drive the sub-pixel to transition from the previous gray level to the current gray level at a first frame rate, selecting a second overdrive value from a second overdrive lookup table for use to drive the sub-pixel to transition from the previous gray level to the current gray level at a second frame rate higher than the first frame rate, generating an initial overdrive value according to the current frame rate and a linear prediction of the first overdrive value and the second overdrive value, selecting an error correction value according to the previous gray level, generating an overdrive weight according to the previous gray level and the current gray level, generating an overdrive offset according to a product of the error correction value, the frame rate weight and the overdrive weight, combining the initial overdrive value and the overdrive offset to generate a corrected overdrive value, and driving the sub-pixel according to the corrected overdrive value.

According to another embodiment, a display device includes a liquid crystal display, a memory, a frame rate detector, an overdrive circuit and an overdrive correction circuit. The liquid crystal display includes a plurality of sub-pixels arranged in an array. The memory is used to store a first overdrive lookup table and a second overdrive lookup table. The frame rate detector is used to determine a current frame rate of a plurality of image frames. The overdrive circuit is coupled to the memory and the frame rate detector, and is used to determine a frame rate weight according to the current frame rate, acquire a previous gray level of a sub-pixel of the plurality of sub-pixels from a previous frame of the plurality of image frames, acquire a current gray level of the sub-pixel from a current frame of the plurality of image frames, the previous frame and the current frame being displayed by the liquid crystal display sequentially in time, select a first overdrive value from the first overdrive lookup table for use to drive the sub-pixel to transition from the previous gray level to the current gray level, select the second overdrive value from a second overdrive lookup table for use to drive the sub-pixel to transition from the previous gray level to the current gray level, and generate an initial overdrive value according to a linear prediction of the first overdrive value and the second overdrive value. The overdrive correction circuit is coupled to the overdrive circuit and the liquid crystal display, and is used to select an error correction value according to the previous gray level, generate an overdrive weight according to the previous gray level and the current gray level, generate an overdrive offset according to a product of the error correction value, the frame rate weight and the overdrive weight, combine the initial overdrive value and the overdrive offset to generate a corrected overdrive value, and drive the sub-pixel according to the corrected overdrive value.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
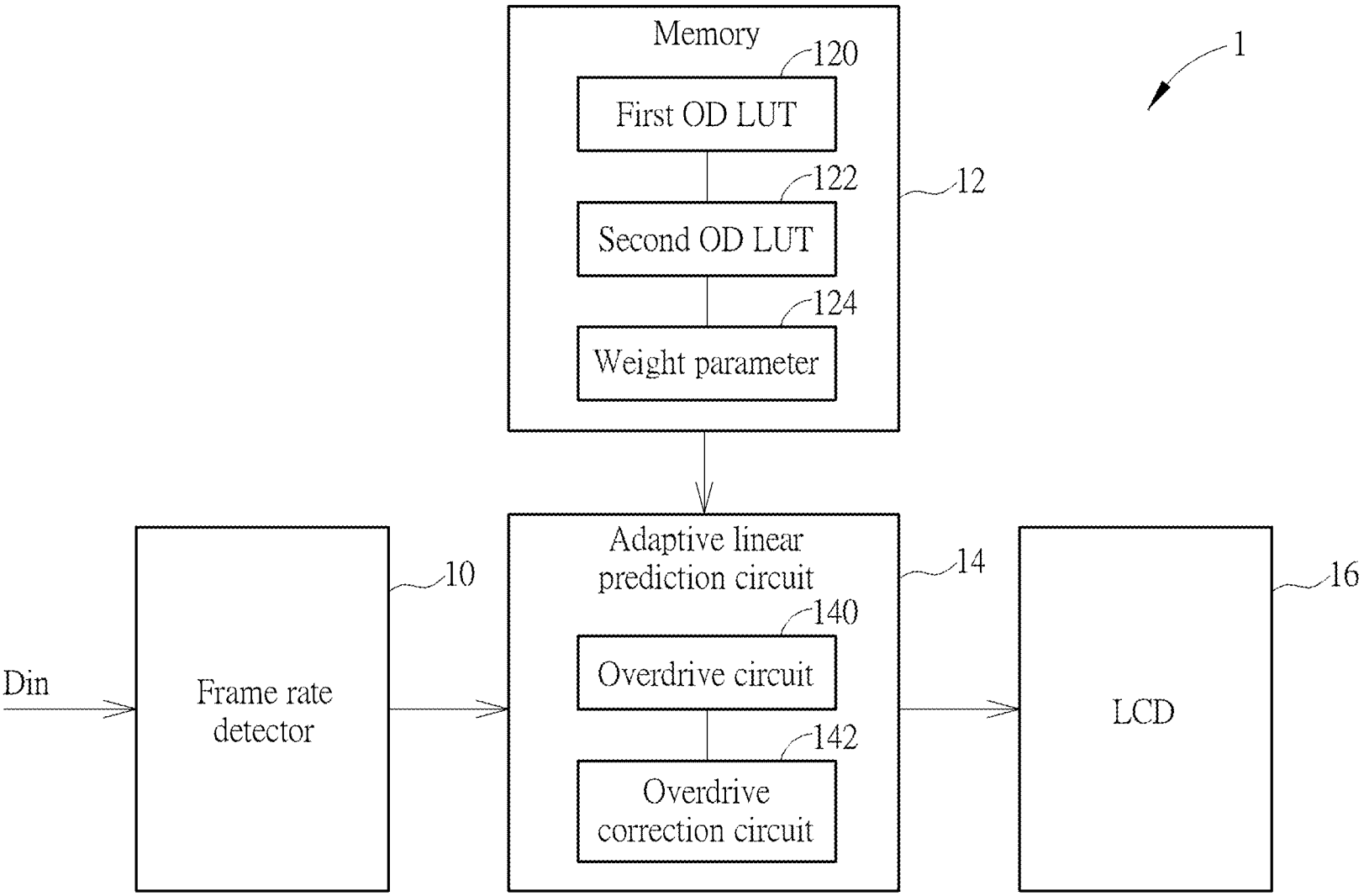
FIG. 1 is a block diagram of a display device according to an embodiment of the invention.

FIG. 1 is a block diagram of a display device 1 according to an embodiment of the invention. The display device 1 may include a liquid crystal display (LCD) 16 containing a plurality of sub-pixels arranged in an array, and each sub-pixel may be red, green or blue in color. The liquid crystal display 16 may display image frames at a range of frame rates, e.g., between 45 Hz and 140 Hz. The display device 1 may receive a gray level Din of each sub-pixel from a frame buffer to generate a corrected overdrive value to transition the sub-pixel from one gray level to another. The corrected overdrive value of the sub-pixel may be closely related to a current frame rate adopted by the liquid crystal display 16 and the gray level of each sub-pixel. The display device 1 may employ linear prediction to generate an initial overdrive value for the sub-pixel, and then perform a fine adjustment on the initial overdrive value according to the gray level of the sub-pixel, thereby delivering the gray level to the sub-pixel using the corrected overdrive value.

The display device 1 may further include a frame rate detector 10, a memory 12 and an adaptive linear prediction circuit 14. The adaptive linear prediction circuit 14 may be coupled to the frame rate detector 10, the memory 12 and the liquid crystal display 16.

The frame rate detector 10 may receive the gray levels Din of each pixel of a plurality of image frames to determine a current frame rate of the plurality of image frames. For example, the current frame rate may be 75 Hz. The frame rate detector 10 may forward the gray levels Din of each pixel of the plurality of image frames to the adaptive linear prediction circuit 14. The gray levels Din may be any value between 0 and a maximum gray level. For an 8-bit image, the maximum gray level may be 255.

The memory 12 may be a non-volatile memory storing a first overdrive lookup table (OD LUT) 120, a second overdrive lookup table 122, and weight parameters 124. The first overdrive lookup table 120, the second overdrive lookup table 122 and the weight parameters 124 may be written into the memory 12 upon manufacturing setup. The first overdrive lookup table 120 may include overdrive values for driving a sub-pixel from a previous gray level to a current gray level at a first frame rate. The second overdrive lookup table 122 may include overdrive values for driving a sub-pixel from a previous gray level to a current gray level at a second frame rate. The second frame rate may be higher than the first frame rate. For example, the first frame rate may be 60 Hz, and the second frame rate may be 120 Hz. In some embodiments, the first frame rate and the second frame rate may be the upper limit and the lower limit of the range of frame rates that the display device 16 may adopt, respectively. In other embodiments, the first frame rate and the second frame rate may be any two frame rates selected from the range of frame rates. Table 1 and Table 2 show truncated portions of the first overdrive lookup table 120 and the second overdrive lookup table 122, respectively. In Table 1 and Table 2, the value at the intersection of a previous gray level and a current gray level may be an overdrive value for driving the sub-pixel from the previous gray level to the current gray level at respective frame rates.

TABLE 1

| | | Previous gray level | |
|---|---|---|---|
| | | 0 | 16 |
| Current gray level | 0 | 0 | 0 |
| | 16 | 75 | 16 |
| | 32 | 142 | 80 |

TABLE 2

| | | Previous gray level | |
|---|---|---|---|
| | | 0 | 16 |
| Current gray level | 0 | 0 | 0 |
| | 16 | 163 | 16 |
| | 32 | 215 | 134 |

The weight parameters 124 may include frame rate weights in form of Table 3 or other forms, and each frame rate weight may be assigned to a specific frame rate. Table 3 shows frame rates FRc and the assigned frame rate weights WFR, the frame rates FRc ranging between 45 Hz and 140 Hz.

TABLE 3

| | | | | | | | | | | |
|---|---|---|---|---|---|---|---|---|---|---|
| FRc | 45 | 50 | 55 | 60 | 65 | 70 | 75 | 80 | 85 | 90 |
| WFR | 1 | 1 | 1 | 0 | 1 | 1.1 | 1.2 | 1.25 | 1.5 | 2 |
| Frc | 95 | 100 | 105 | 110 | 115 | 120 | 125 | 130 | 135 | 140 |
| WFR | 1.5 | 1.25 | 1.2 | 1.1 | 1 | 0 | 1 | 1 | 1 | 1 |

The weight parameters 124 may further include error correction values in form of Table 4 or other forms, and each error correction value may be assigned to a specific previous gray level. Table 4 shows previous gray levels Dp and the assigned error correction values EC, the previous gray levels Dp ranging between 0 and 255.

TABLE 4

| | | | | | | | | | |
|---|---|---|---|---|---|---|---|---|---|
| Dp | 0 | 15 | 31 | 47 | 63 | 79 | 95 | 111 | 127 |
| EC | 4 | 3 | 2 | 1 | 1 | 1 | 1 | 1 | 1 |
| Dp | 143 | 159 | 175 | 191 | 207 | 223 | 239 | 255 | |
| EC | 1 | 1 | 1 | 1 | 1 | 2 | 3 | 4 | |

The adaptive linear prediction circuit 14 may include an overdrive circuit 140 and an overdrive correction circuit 142 coupled thereto. The overdrive circuit 140 may determine a frame rate weight WFR from the weight parameters 124 according to the current frame rate. For example, the adaptive linear prediction circuit 14 may determine from Table 3 that a current frame rate of 75 Hz corresponds to a frame rate weight of 1.2. The overdrive circuit 140 may further generate the initial overdrive value for each sub-pixel according to the linear prediction of a line fitting two overdrive values respectively selected from the first overdrive lookup table 120 and the second overdrive lookup table 122. The linear predication may be linear interpolation or linear extrapolation. The initial overdrive value is just a crude estimate, and may be different from the desired overdrive value for use to drive the sub-pixel to transition from the previous gray level to the current gray level. The error between the desired overdrive value and the initial overdrive value is compensated for by the overdrive correction circuit 142.

Figure 2:
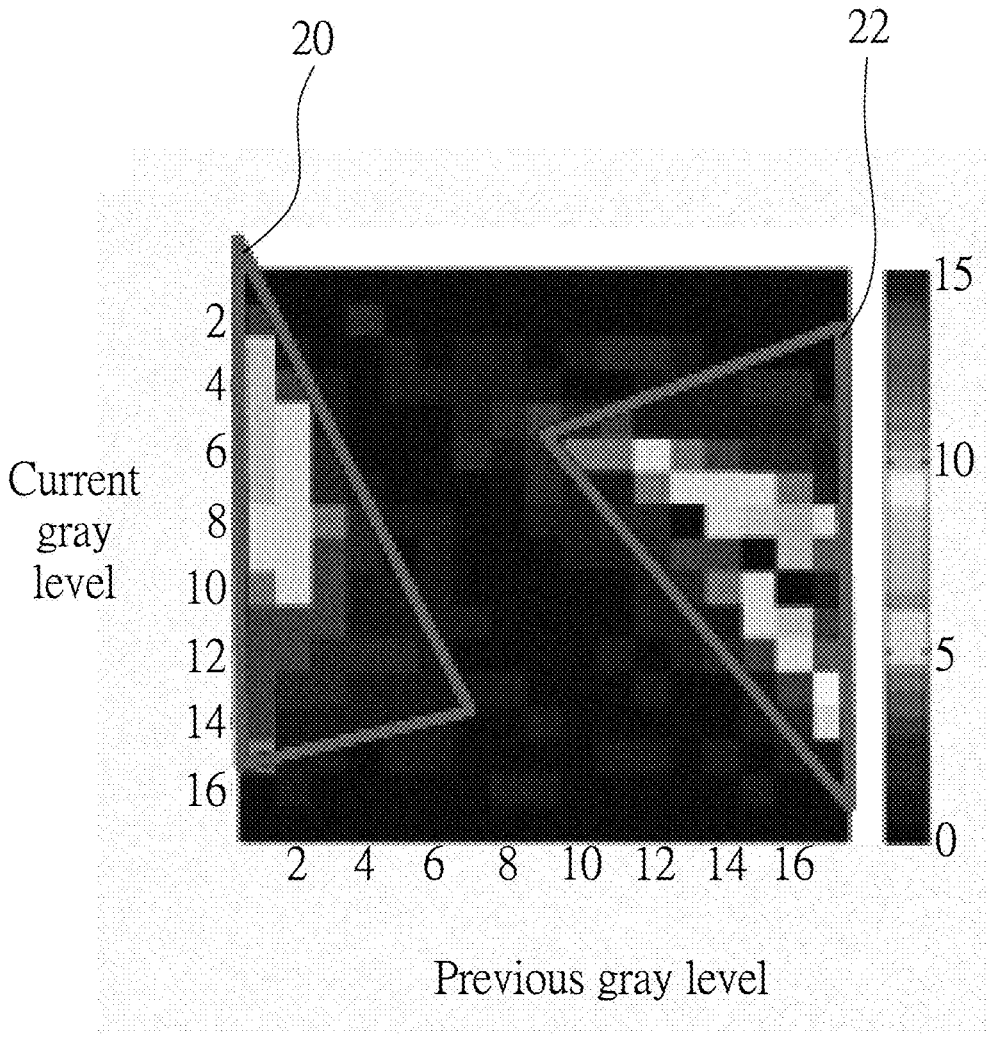
FIG. 2 is a flowchart of a method of driving the liquid crystal display in FIG. 1.

FIG. 2 shows an error distribution of driving a sub-pixel using the initial overdrive value at a current frame rate. The current frame rate is different from the frame rates of the first overdrive lookup table 120 and the second overdrive lookup table 122. In the embodiments, the frame rates of the first overdrive lookup table 120 and the second overdrive lookup table 122 are 60 Hz and 120 Hz, respectively, and the current frame rate is 90 Hz. The horizontal axis represents the previous gray level of the sub-pixel and the vertical axis represents the current gray level of the sub-pixel. The lighter spots indicate larger errors between the desired overdrive value and the initial overdrive value. Areas 20 and 22 highlight two conditions where the larger errors occur and an error correction is performed by the overdrive correction circuit 142. The area 20 addresses the condition where the sub-pixel is driven from a previous gray level in a low range to a current gray level in a middle-to-low range. In some embodiments, the low range may be set between 0 and 63, and the middle-to-low range may be set between 0 and 127. The area 22 addresses the condition where the sub-pixel is driven from a previous gray level in a high range to a current gray level in a middle-to-high range. In some embodiments, the high range may be set between 192 and 255, and the middle-to-high range may be set between 128 and 255. While specific ranges are provided in the embodiment, other ranges may be adopted by the overdrive correction circuit 142 to compensate for the errors.

Figure 3:
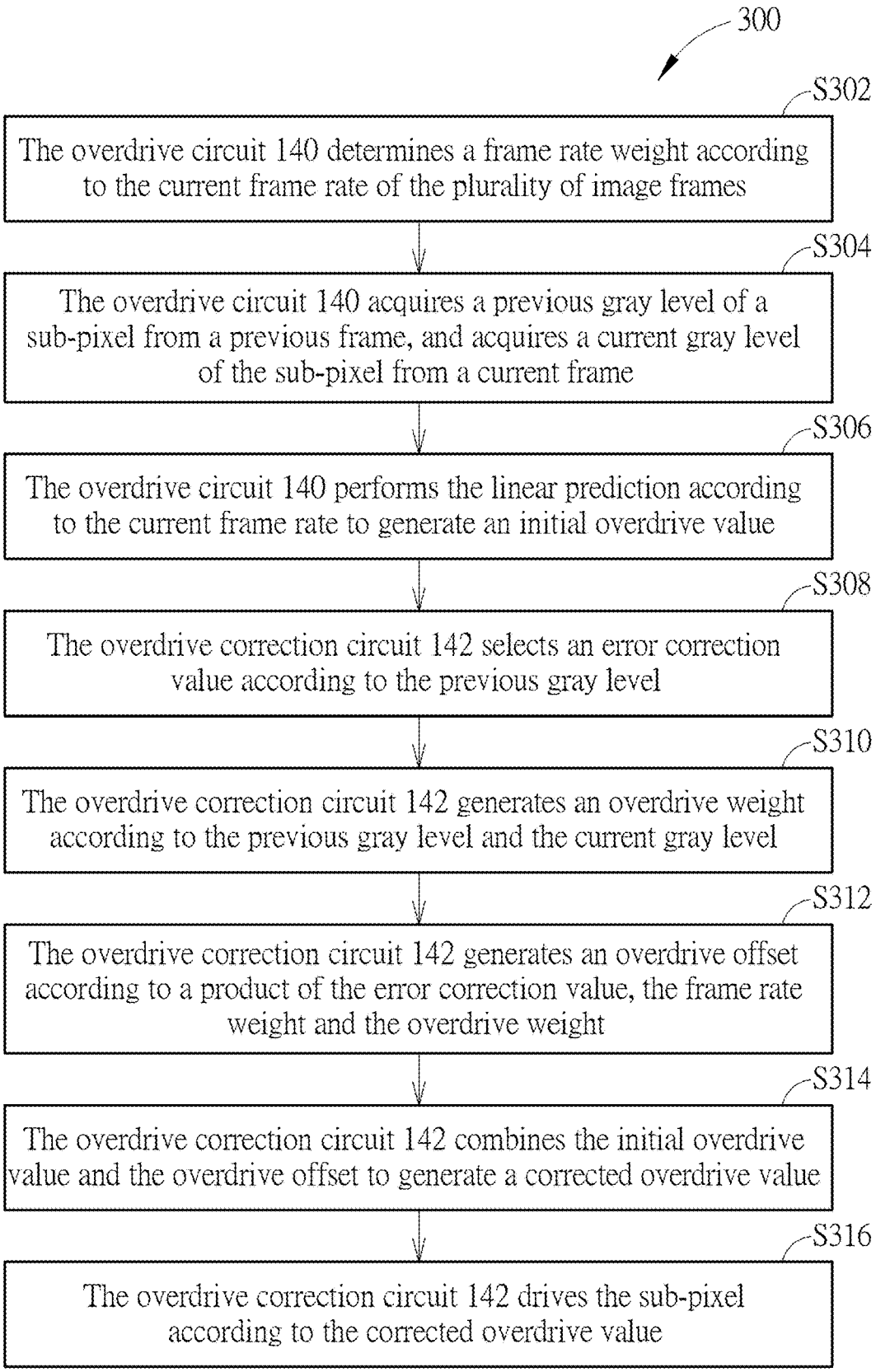
FIG. 3 is a flowchart of a method of implementing Step S206 in FIG. 2.

The overdrive correction circuit 142 may compensate for the error by performing the fine adjustment on the initial overdrive value according to a current gray level and a previous gray level of each sub-pixel, thereby delivering a corrected overdrive value for use to drive the sub-pixel to the current gray level in a prompt and accurate manner. Operations of the overdrive circuit 140 and an overdrive correction circuit 142 are detailed by a method 300 of driving the liquid crystal display 1 in FIG. 3.

The method 300 includes Steps S302 to S316. Steps S302 to S306 are used to generate an initial overdrive value of a sub-pixel based on the linear prediction. Steps S308 to S314 are used to perform the error compensation on the initial overdrive value to generate a corrected overdrive value of the sub-pixel. Any reasonable technical changes or step adjustments are within the scope of the present invention. The following details Steps S302 to S316:

Step S302: The overdrive circuit 140 determines a frame rate weight according to the current frame rate of the plurality of image frames;

Step S304: The overdrive circuit 140 acquires a previous gray level of a sub-pixel from a previous frame, and acquires a current gray level of the sub-pixel from a current frame;

Step S306: The overdrive circuit 140 performs the linear prediction according to the current frame rate to generate an initial overdrive value;

Step S308: The overdrive correction circuit 142 selects an error correction value according to the previous gray level;

Step S310: The overdrive correction circuit 142 generates an overdrive weight according to the previous gray level and the current gray level;

Step S312: The overdrive correction circuit 142 generates an overdrive offset according to a product of the error correction value, the frame rate weight and the overdrive weight;

Step S314: The overdrive correction circuit 142 combines the initial overdrive value and the overdrive offset to generate a corrected overdrive value;

Step S316: The overdrive correction circuit 142 drives the sub-pixel according to the corrected overdrive value.

In Step S304, the previous frame and the current frame are two image frames arranged sequentially in time in the plurality of image frames, and the previous gray level and the current gray level are gray levels corresponding to the sub-pixel in the previous frame and the current frame, respectively. In Step S306, the overdrive circuit 140 determines two overdrive values respectively from the first overdrive lookup table 120 and the second overdrive lookup table 122 according to the previous gray level and the current gray level, and generates the initial overdrive value by applying the linear prediction of the line fitting the two overdrive values according to the current frame rate. The initial overdrive value and the overdrive values from the first overdrive lookup table 120 and the second overdrive lookup table 122 may be measured in unit of gray level or voltage. Details of Step S306 are provided in FIG. 4. In Step S308, the overdrive correction circuit 142 selects the error correction value from the weight parameters 124 according to the previous gray level to serve as a basis for adjusting the initial overdrive value. In Step S310, when the previous gray level and the current gray level satisfy the conditions set out by the areas 20 and 22 in FIG. 2, the overdrive correction circuit 142 generates the overdrive weight according to the previous gray level and the current gray level to adjust the error correction value. Details of Step S310 are provided in FIGS. 5 and 6. In Step S312, the overdrive correction circuit 142 multiplies the error correction value, the frame rate weight and the overdrive weight to generate the overdrive offset. The error correction value and the overdrive offset may adopt a unit identical to that of the initial overdrive value, and may be in unit of gray level or voltage. When the current frame rate is equal to the frame rate of the first overdrive lookup table 120 or the second overdrive lookup table 122, the frame rate weight will be zero, leading to an overdrive offset of 0. When the current frame rate is different from the frame rates of the first overdrive lookup table 120 and the second overdrive lookup table 122, the overdrive offset is non-zero, compensating for the error between the desired overdrive value and the initial overdrive value. The overdrive correction circuit 142 then adds the overdrive offset into the initial overdrive value to generate the corrected overdrive value (S316), and drives the sub-pixel according to the corrected overdrive value (S318). The corrected overdrive value may adopt a unit identical to that of the initial overdrive value and the overdrive offset, and may be in gray level or voltage. In some embodiments when corrected overdrive value adopts the unit in gray level, the overdrive correction circuit 142 may convert the corrected overdrive value from a gray level to a voltage, and drive the sub-pixel using the converted voltage.

The overdrive circuit 140 and the overdrive correction circuit 142 may iterate the method 300 over the gray level of every sub-pixel of the liquid crystal device 16 to generate corrected overdrive values to drive the same.

Figure 4:
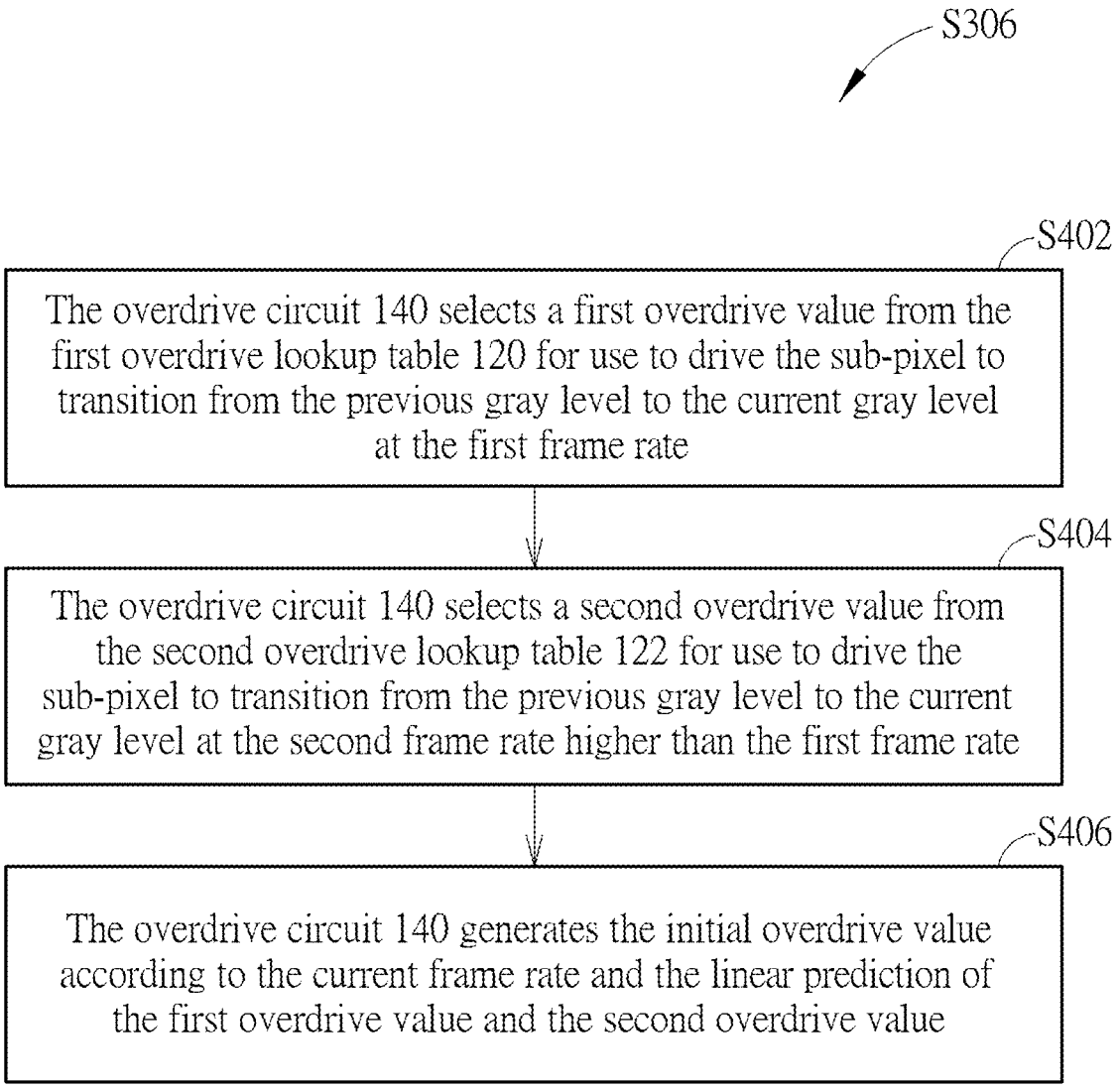
FIG. 4 shows an error distribution of driving a sub-pixel at a current frame rate without an error correction.

FIG. 4 is a flowchart of a linear prediction method implementing Step S306 and including Steps S402 to S406. Any reasonable technical changes or step adjustments are within the scope of the present invention. The following details Steps S402 to S406:

Step S402: The overdrive circuit 140 selects a first overdrive value from the first overdrive lookup table 120 for use to drive the sub-pixel to transition from the previous gray level to the current gray level at the first frame rate;

Step S404: The overdrive circuit 140 selects a second overdrive value from the second overdrive lookup table 122 for use to drive the sub-pixel to transition from the previous gray level to the current gray level at the second frame rate higher than the first frame rate;

Step S406: The overdrive circuit 140 generates the initial overdrive value according to the current frame rate and the linear prediction of the first overdrive value and the second overdrive value.

The linear prediction method may be embodied by an example of determining an initial overdrive value for driving the sub-pixel from a previous gray level of 0 to a current gray level of 32 at a current frame rate of 75 Hz, using the truncated first overdrive lookup table 120 in Table 1 and the truncated second overdrive lookup table 122 in Table 2. Table 1 is associated with the first frame rate of 60 Hz, and Table 2 is associated with the second frame rate of 120 Hz.

In Step S402, the adaptive linear prediction circuit 14 selects from Table 1 the value "142" at the intersection of the previous gray level "0" and the current gray level "32" as the first overdrive value, and in Step S404, the adaptive linear prediction circuit 14 selects from Table 2 the value "215" at the intersection of the previous gray level "0" and the current gray level "32" as the second overdrive value. In Step S406, the adaptive linear prediction circuit 14 computes the initial overdrive value using Equation (1):

$$ODini = \left(\frac{FRc - FR1}{FR2 - FR1}\right) * (OD(FR2) - OD(FR1)) + OD(FR1) \quad \text{Equation (1)}$$

Where ODini is the initial overdrive value;
FRc is the current frame rate;
FR1 is the first frame rate of the first overdrive lookup table 120;
FR2 is the first frame rate of the second overdrive lookup table 122;
OD(FR1) is the first overdrive value; and
OD(FR2) is the second overdrive value.

The initial overdrive value ODini is computed approximately as $$160\left(=\left(\frac{75-60}{120-60}\right)*(215-142)+142\right).$$

Figure 5:
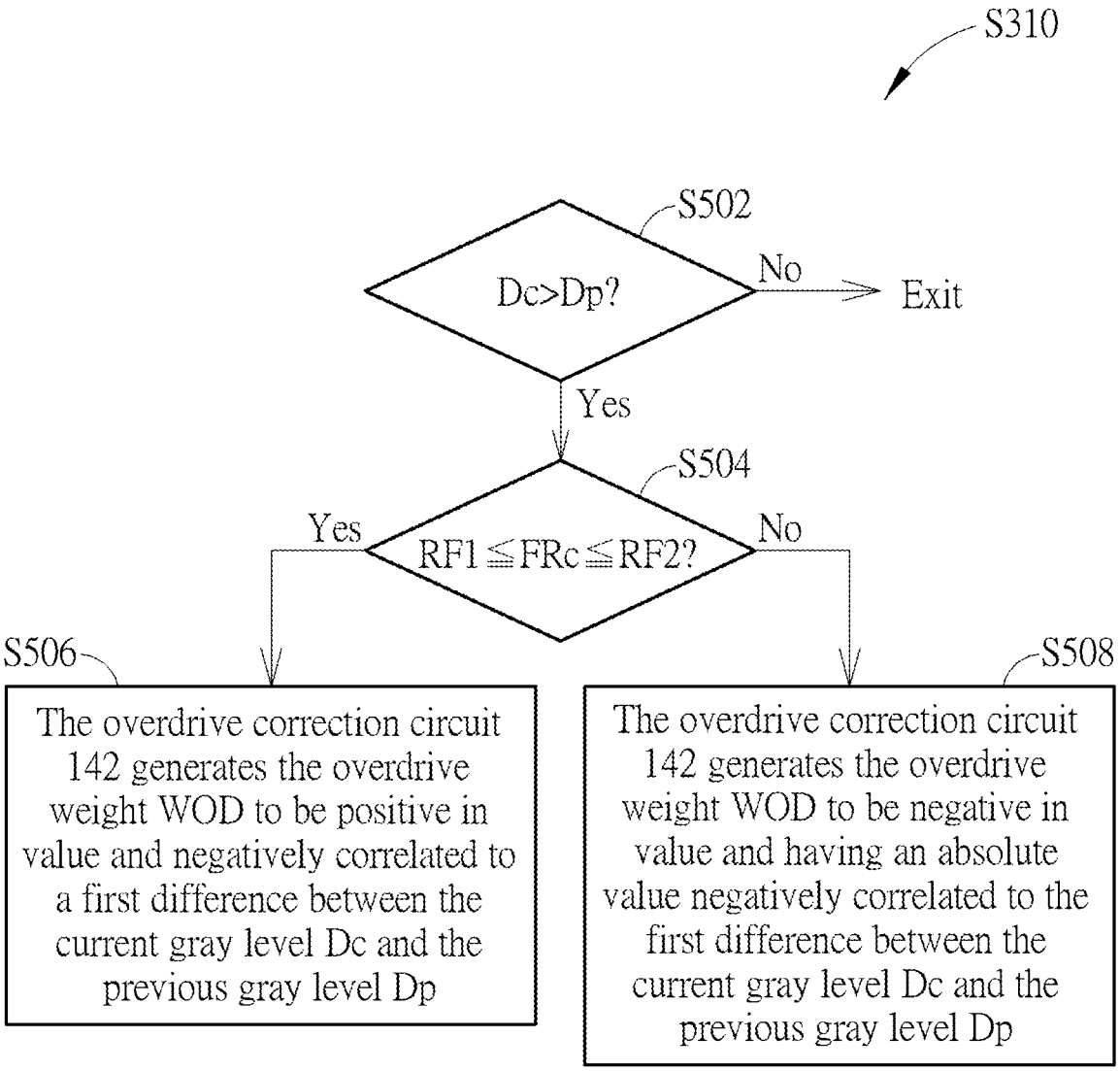
FIG. 5 is a flowchart of a method of implementing Step S210 in FIG. 2 according to an embodiment of the invention.

FIG. 5 is a flowchart of a method implementing Step S310 and including Steps S502 to S508. The method in FIG. 5 is used to compensate for the error in the area 20 in FIG. 2. Any reasonable technical changes or step adjustments are within the scope of the present invention. The following details Steps S502 to S508:

Step S502: The overdrive correction circuit 142 determines whether the current gray level Dc exceeds the previous gray level Dp? if so, go to Step S504, and if not, exit the method;

Step S504: The overdrive correction circuit 142 determines if the current frame rate FRc is between the first frame rate FR1 and the second frame rate FR2? if so, go to Step S506, and if not, go to Step S508;

Step S506: The overdrive correction circuit 142 generates the overdrive weight WOD to be positive in value and negatively correlated to a first difference between the current gray level Dc and the previous gray level Dp;

Step S508: The overdrive correction circuit 142 generates the overdrive weight WOD to be negative in value and having an absolute value negatively correlated to the first difference between the current gray level Dc and the previous gray level Dp.

In the method, the overdrive weight WOD may be defaulted at 1. In Step S502, the overdrive correction circuit 142 determines whether the current gray level Dc and the previous gray level Dp satisfy the condition set out by the area 20 in FIG. 2. When the condition is not satisfied, the method is exited, and default overdrive weight WOD of 1 is used in the subsequent steps in the method 300. When the condition is satisfied, the overdrive correction circuit 142 determines whether the linear prediction is the linear interpolation or the linear extrapolation in Step S504. When the current frame rate FRc is between the first frame rate FR1 and the second frame rate FR2, the linear prediction is the linear interpolation, and when the current frame rate FRc is lower than the first frame rate FR1 or higher than the second frame rate FR2, the linear prediction is the linear extrapolation. In some embodiments, the overdrive correction circuit 142 may generate the overdrive weight WOD using Equation (2) in the case of the linear interpolation (S506), and may generate the overdrive weight WOD using Equation (3) in the case of the linear extrapolation (S508).

$$\mathrm{WOD}=(\mathrm{GLmax}-(Dc-Dp))*\mathrm{W12}h/\mathrm{GLres} \qquad \text{Equation (2)}$$

$$\mathrm{WOD}=-(\mathrm{GLmax}-(Dc-Dp))*\mathrm{W12}h/\mathrm{GLres} \qquad \text{Equation (3)}$$

Where WOD is the overdrive weight;
GLmax is the maximum gray level;
Dc is the current gray level;
Dp is the previous gray level;
W12*h* is a first weight; and
GLres is the gray level resolution.

Based on Equation (2) and Equation (3), the overdrive weights WOD adopted in the linear interpolation and in the linear extrapolation are different by a negative sign. Since the maximum gray level GLmax is greater than or equal to the current gray level Dc, When Equation (2) is adopted, the overdrive weights WOD is positive in value, and when Equation (3) is adopted, the overdrive weights WOD is negative in value.

The overdrive correction circuit 142 may generate the first difference (Dc−Dp) between the current gray level Dc and the previous gray level Dp, generate a second difference (GLmax−(Dc−Dp)) between the maximum gray level GLmax and the first difference (Dc−Dp), divide the second difference (GLmax−(Dc−Dp)) by the gray level resolution GLres to generate a proportion (GLmax−(Dc−Dp))/GLres, and multiply the proportion (GLmax−(Dc−Dp))/GLres with the first weight W12*h* to generate the overdrive weight WOD. The gray level resolution GLres may be 256 for an 8-bit image. The first weight W12*h* may be 1 and may be constant for all current frame rates adopted by the display device 1. In some embodiments, the first weight W12*h* may be different from 1 and may be set according to design requirements. An increased first weight W12*h* will result in an increase in the absolute value of the overdrive weight WOD, and a decreased first weight W12*h* will result in a decrease in the absolute value of the overdrive weight WOD. In some embodiments, the first weight W12*h* may be specific to each different current frame rate. The first weight W12*h* may be stored in the memory 120.

The computation of the overdrive weights WOD may be illustrated by the example used for embodying the linear prediction method. Accordingly, the overdrive correction circuit 142 determines that the current frame rate FRc "75" is between the first frame rate RF1 "60" and the second frame rate FR2 "120" (S504), and therefore, generates that overdrive weight WOD to be 0.87 (=(255−(32−0)*1/256) using Equation (2) (S506).

Referring to the method 300, the overdrive circuit 140 determines the frame rate weight WFR to be 1.2 from Table 3 according to the current frame rate FRc "75" (S302), and the overdrive correction circuit 142 selects the error correction value EC to be 4 from Table 4 according to the previous gray level "0" (S308), generates the overdrive offset to be 4.18 (=4*1.2*0.87), combines the initial overdrive value ODini "160" and the overdrive offset "4.18" to generate the corrected overdrive value "164", and drive the corresponding sub-pixel according to the corrected overdrive value "164".

Table 5 shows a truncated portion of an actual overdrive lookup table for a frame rate of 75 Hz. The overdrive values in Table 5 are the desired overdrive values to drive the sub-pixel from the previous gray level to the current gray level at the frame rate of 75 Hz. It can be observed that the desired overdrive value "167" is required to drive the sub-pixel from the previous gray level "0" to the current gray level "32". The corrected overdrive value "164" is closer to the desired overdrive value "167" in comparison to the initial overdrive value "160". Therefore, driving the sub-pixel using the corrected overdrive value "164" will deliver brightness better matched the current gray level "32" than using the initial overdrive value "160". Rather than adopting overdrive lookup tables for all frame rate available to the display device 1, the embodiments employ two overdrive lookup tables 120 and 122 to generate the initial overdrive value, and compensates for the error of the initial overdrive value using simple arithmetic operations as outlined in FIG. 5 to generate the corrected overdrive value, increasing accuracy using a simple compensation mechanism while reducing hardware resource requirements.

TABLE 5

| | | Previous gray level | |
|---|---|---|---|
| | | 0 | 16 |
| Current gray level | 0 | 0 | 0 |
| | 16 | 100 | 16 |
| | 32 | 167 | 95 |

Figure 6:
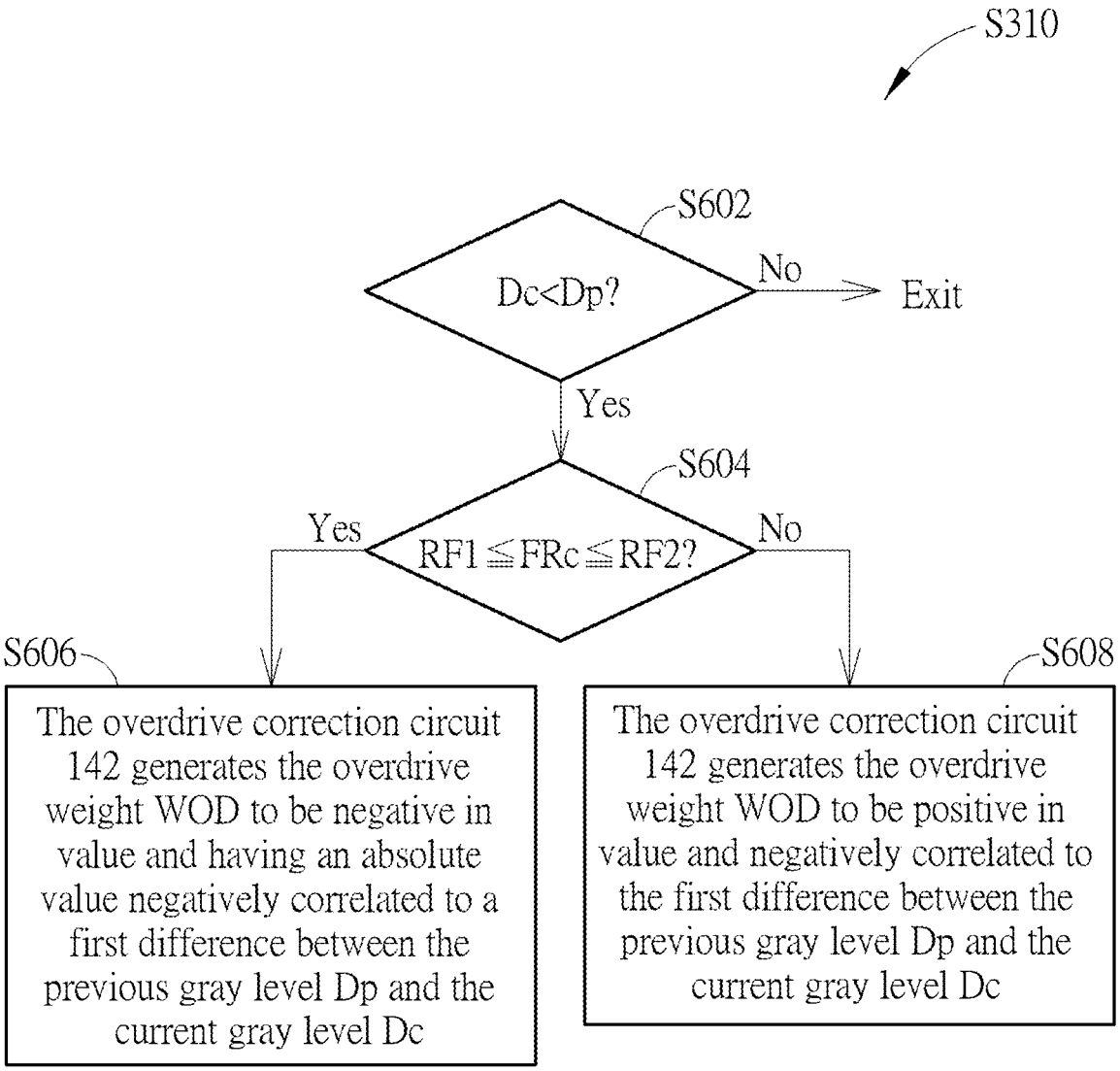
FIG. 6 is a flowchart of a method of implementing Step S210 in FIG. 2 according to another embodiment of the invention.

FIG. 6 is a flowchart of a method of a method implementing Step S310 and including Steps S602 to S608. The method in FIG. 6 is used to compensate for the error in the area 22 in FIG. 2. Any reasonable technical changes or step adjustments are within the scope of the present invention. The following details Steps S602 to S608:

Step S602: The overdrive correction circuit 142 determines whether the current gray level Dc is less than the previous gray level Dp? if so, go to Step S604, and if not, exit the method;

Step S604: The overdrive correction circuit 142 determines if the current frame rate FRc is between the first frame rate FR1 and the second frame rate FR2? if so, go to Step S606, and if not, go to Step S608;

Step S606: The overdrive correction circuit 142 generates the overdrive weight WOD to be negative in value and having an absolute value negatively correlated to a first difference between the previous gray level Dp and the current gray level Dc;

Step S608: The overdrive correction circuit 142 generates the overdrive weight WOD to be positive in value and negatively correlated to the first difference between the previous gray level Dp and the current gray level Dc.

In the method, the overdrive weight WOD may be defaulted at 1. In Step S602, the overdrive correction circuit 142 determines whether the current gray level Dc and the previous gray level Dp satisfy the condition set out by the area 22 in FIG. 2. When the condition is not satisfied, the method is exited, and default overdrive weight WOD of 1 is used in the subsequent steps in the method 300. When the condition is satisfied, the overdrive correction circuit 142 determines whether the linear prediction is the linear interpolation or the linear extrapolation in Step S604. When the current frame rate FRc is between the first frame rate FR1 and the second frame rate FR2, the linear prediction is the linear interpolation, and when the current frame rate FRc is lower than the first frame rate FR1 or higher than the second frame rate FR2, the linear prediction is the linear extrapolation. In some embodiments, the overdrive correction circuit 142 may generate the overdrive weight WOD using Equation (4) in the case of the linear interpolation (S606), and may generate the overdrive weight WOD using Equation (5) in the case of the linear extrapolation (S608).

$$WOD=(Dp-Dc-GLmax)*Wh21/GLres \quad \text{Equation (4)}$$

$$WOD=-(Dp-Dc-GLmax)*Wh21/GLres \quad \text{Equation (5)}$$

Where WOD is the overdrive weight;
GLmax is the maximum gray level;
Dc is the current gray level;
Dp is the previous gray level;
Wh21 is a second weight; and
GLres is the gray level resolution.

Based on Equation (4) and Equation (5), the overdrive weights WOD adopted in the linear interpolation and in the linear extrapolation are different by a negative sign. Since the maximum gray level GLmax is greater than or equal to the previous gray level Dp, when Equation (4) is adopted, the overdrive weights WOD is negative in value, and when Equation (5) is adopted, the overdrive weights WOD is positive in value.

The overdrive correction circuit 142 may generate the first difference (Dp-Dc) between the previous gray level Dp and the current gray level Dc, generate a second difference ((Dc−Dp)−GLmax) between the first difference (Dc−Dp) and the maximum gray level GLmax, divide the second difference ((Dc−Dp)−GLmax) by the gray level resolution GLres to generate a proportion ((Dc−Dp)−GLmax)/GLres, and multiply the proportion ((Dc−Dp)−GLmax)/GLres with the second weight Wh21 to generate the overdrive weight WOD. The second weight Wh21 may be 1 and may be constant for all current frame rates adopted by the display device 1. In some embodiments, the second weight Wh21 may be different from 1 and may be set according to design requirements. An increased second weight Wh21 will result in an increase in the absolute value of the overdrive weight WOD, and a decreased second weight Wh21 will result in a decrease in the absolute value of the overdrive weight WOD. In some embodiments, the second weight Wh21 may be specific to each different current frame rate. The second weight Wh21 may be stored in the memory 120.

Step S310 may be implemented by the method in FIG. 5 to compensate for the error in the area 20 in FIG. 2, by the method in FIG. 6 to compensate for the error in the area 22 in FIG. 2, or by both the methods in FIG. 5 and FIG. 6 to compensate for the error in the areas 20 and 22 in FIG. 2. When a joint method including both the methods in FIG. 5 and FIG. 6 is adopted, the method is exited when the conditions of both Steps S502 and S602 are not satisfied.

The display device 1 and the method 300 employ the linear prediction to generate the initial overdrive value, and then perform the error compensation on the initial overdrive value to generate the corrected overdrive value, reducing hardware resource requirements while delivering the corrected overdrive value in in a simple, quick and accurate manner.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method of driving a liquid crystal display, the liquid crystal display comprising a plurality of sub-pixels arranged in an array, the method comprising:

determining a frame rate weight according to a current frame rate of a plurality of image frames;

acquiring a previous gray level of a sub-pixel of the plurality of sub-pixels from a previous frame of the plurality of image frames;

acquiring a current gray level of the sub-pixel from a current frame of the plurality of image frames, the previous frame and the current frame being displayed by the liquid crystal display sequentially in time;

selecting a first overdrive value from a first overdrive lookup table for use to drive the sub-pixel to transition from the previous gray level to the current gray level at a first frame rate;

selecting a second overdrive value from a second overdrive lookup table for use to drive the sub-pixel to transition from the previous gray level to the current gray level at a second frame rate higher than the first frame rate;

generating an initial overdrive value according to the current frame rate and a linear prediction of the first overdrive value and the second overdrive value;

selecting an error correction value according to the previous gray level;

generating an overdrive weight according to the previous gray level and the current gray level;

generating an overdrive offset according to a product of the error correction value, the frame rate weight and the overdrive weight;

combining the initial overdrive value and the overdrive offset to generate a corrected overdrive value; and driving the sub-pixel according to the corrected overdrive value.

2. The method of claim 1, wherein generating the overdrive weight according to the previous gray level and the current gray level comprises:

when the current gray level exceeds the previous gray level, generating the overdrive weight to have an absolute value negatively correlated to a first difference between the current gray level and the previous gray level.

3. The method of claim 2, wherein generating the overdrive weight to have the absolute value negatively correlated to the first difference between the current gray level and the previous gray level comprises:

generating the first difference between the current gray level and the previous gray level;

generating a second difference between a maximum gray level and the first difference;

dividing the second difference by a gray level resolution to generate a proportion; and multiplying the proportion with a first weight to generate the overdrive weight.

4. The method of claim 1, wherein generating the overdrive weight according to the previous gray level and the current gray level comprises:

when the current gray level exceeds the previous gray level, if the current frame rate is between the first frame rate and the second frame rate, generating the overdrive weight to be positive in value; and if the current frame rate is lower than the first frame rate or higher than the second frame rate, generating the overdrive weight to be negative in value.

5. The method of claim 1, wherein generating the overdrive weight according to the previous gray level and the current gray level comprises:

when the current gray level is less than the previous gray level, generating the overdrive weight to have an absolute value negatively correlated to a first difference between the previous gray level and the current gray level.

6. The method of claim 5, wherein generating the overdrive weight to have the absolute value negatively correlated to the first difference between the previous gray level and the current gray level comprises:

generating the first difference between the previous gray level and the current gray level;

generating a second difference between the first difference and a maximum gray level;

dividing the second difference by a gray level resolution to generate a proportion; and multiplying the proportion with a second weight to generate the overdrive weight.

7. The method of claim 1, wherein generating the overdrive weight according to the previous gray level and the current gray level comprises:

when the current gray level is less than the previous gray level, if the current frame rate is between the first frame rate and the second frame rate, generating the overdrive weight to be negative in value; and if the current frame rate is lower than the first frame rate or higher than the second frame rate, generating the overdrive weight to be positive in value.

8. A display device comprising a liquid crystal display comprising a plurality of sub-pixels arranged in an array;

a memory configured to store a first overdrive lookup table and a second overdrive lookup table;

a frame rate detector configured to determine a current frame rate of a plurality of image frames;

an overdrive circuit coupled to the memory and the frame rate detector, and configured to determine a frame rate weight according to the current frame rate, acquire a previous gray level of a sub-pixel of the plurality of sub-pixels from a previous frame of the plurality of image frames, acquire a current gray level of the sub-pixel from a current frame of the plurality of image frames, the previous frame and the current frame being displayed by the liquid crystal display sequentially in time, select a first overdrive value from the first overdrive lookup table for use to drive the sub-pixel to transition from the previous gray level to the current gray level, select a second overdrive value from the second overdrive lookup table for use to drive the sub-pixel to transition from the previous gray level to the current gray level, and generate an initial overdrive value according to a linear prediction of the first overdrive value and the second overdrive value; and an overdrive correction circuit coupled to the overdrive circuit and the liquid crystal display, and configured to select an error correction value according to the previous gray level, generate an overdrive weight according to the previous gray level and the current gray level, generate an overdrive offset according to a product of the error correction value, the frame rate w eight and the overdrive w eight, combine the initial overdrive value and the overdrive offset to generate a corrected overdrive value, and drive the sub-pixel according to the corrected overdrive value.

9. The display device of claim 8, wherein when the current gray level exceeds the previous gray level, the overdrive correction circuit is configured to generate the overdrive weight to have an absolute value negatively correlated to a first difference between the current gray level and the previous gray level.

10. The display device of claim 8, wherein when the current gray level exceeds the previous gray level, the overdrive correction circuit is configured to:

generate the first difference between the current gray level and the previous gray level;

generate a second difference between a maximum gray level and the first difference;

divide the second difference by a gray level resolution to generate a proportion; and multiply the proportion with a first weight to generate the overdrive weight.

11. The display device of claim 8, wherein when the current gray level exceeds the previous gray level, the overdrive correction circuit is configured to:

generate the overdrive weight to be positive in value if the current frame rate is between the first frame rate and the second frame rate; and generate the overdrive weight to be negative in value if the current frame rate is lower than the first frame rate or higher than the second frame rate.

12. The display device of claim 8, wherein when the current gray level is less than the previous gray level, the overdrive correction circuit is configured to generate the overdrive weight to be have an absolute value negatively to a first difference between the previous gray level and the current gray level.

13. The display device of claim 12, wherein when the current gray level is less than the previous gray level, the overdrive correction circuit is configured to:

generate the first difference between the previous gray level and the current gray level;

generate a second difference between the first difference and a maximum gray level;

divide the second difference by a gray level resolution to generate a proportion; and multiply the proportion with a second weight to generate the overdrive weight.

14. The display device of claim 8, wherein when the current gray level is less than the previous gray level, the overdrive correction circuit is configured to:

generate the overdrive weight to be negative in value if the current frame rate is between the first frame rate and the second frame rate; and generate the overdrive weight to be positive in value if the current frame rate is lower than the first frame rate or higher than the second frame rate.

* * * * *